US009222760B2

(12) United States Patent
Bliehall

(10) Patent No.: US 9,222,760 B2
(45) Date of Patent: Dec. 29, 2015

(54) PORTABLE TARGET APPARATUS

(71) Applicant: James Bliehall, Cedar Crest, NM (US)

(72) Inventor: James Bliehall, Cedar Crest, NM (US)

( * ) Notice: Subject to any disclaimer, the term of this patent is extended or adjusted under 35 U.S.C. 154(b) by 0 days.

(21) Appl. No.: 14/535,010

(22) Filed: Nov. 6, 2014

(65) Prior Publication Data

US 2015/0130136 A1 May 14, 2015

Related U.S. Application Data

(60) Provisional application No. 61/962,489, filed on Nov. 9, 2013.

(51) Int. Cl.

| | |
|---|---|
| ***F41J 7/04*** | (2006.01) |
| ***F41J 5/20*** | (2006.01) |
| *F41J 5/18* | (2006.01) |

(52) U.S. Cl.

CPC ..... *F41J 5/20* (2013.01); *F41J 5/18* (2013.01); *F41J 7/04* (2013.01)

(58) Field of Classification Search

CPC ..... F41J 1/00; F41J 7/04; F41J 1/10; F41J 5/18; F41J 7/06; F41J 7/00

USPC ..... 273/378–393, 403–410

See application file for complete search history.

(56) References Cited

U.S. PATENT DOCUMENTS

| | | | | |
|---|---|---|---|---|
| 1,266,494 | A * | 5/1918 | Lakin | 273/383 |
| 1,341,814 | A * | 6/1920 | Mosby | 273/385 |
| 1,348,540 | A * | 8/1920 | Briggs | 273/388 |
| 2,039,552 | A * | 5/1936 | Reynolds | 273/391 |
| 2,905,469 | A * | 9/1959 | Taylor | 273/380 |
| 2,957,694 | A * | 10/1960 | Barber et al. | 273/388 |
| 3,814,429 | A * | 6/1974 | Lienhard | 273/368 |
| 4,743,032 | A * | 5/1988 | Summers et al. | 273/372 |
| 5,240,258 | A * | 8/1993 | Bateman | 273/392 |
| 5,257,790 | A * | 11/1993 | Meadows | 273/389 |
| 5,676,378 | A * | 10/1997 | West | 273/390 |
| 7,128,321 | B1 * | 10/2006 | Brown | 273/392 |
| 7,556,268 | B2 * | 7/2009 | Bateman et al. | 273/406 |
| 8,684,361 | B2 * | 4/2014 | Henson et al. | 273/406 |
| 2006/0290063 | A1 * | 12/2006 | Hagar | 273/369 |
| 2008/0185786 | A1 * | 8/2008 | Loveland et al. | 273/391 |
| 2008/0277876 | A1 * | 11/2008 | Riley | 273/388 |
| 2009/0179382 | A1 * | 7/2009 | Stincelli et al. | 273/392 |

* cited by examiner

*Primary Examiner* — Mark Graham

(74) *Attorney, Agent, or Firm* — The Concept Law Group, P.A.; Scott D. Smiley; Erin A. Martin

(57) ABSTRACT

A portable target apparatus is disclosed that includes a main body and a first target plate adjacent the main body. The first target plate is operable to move independent of the main body when struck by at least one projectile. A support member is coupled to the first target plate and is operable to retain the main body in an upright position when the main body is struck by at least one projectile and move the main body from the upright position to a non-upright position when the first target plate is struck by at least one projectile.

13 Claims, 10 Drawing Sheets

PORTABLE TARGET APPARATUS

CROSS-REFERENCE TO RELATED APPLICATION

This application claims priority to U.S. Provisional Patent Application No. 61/962,489 filed on Nov. 9, 2013, the entirety of which is incorporated herein by reference.

FIELD OF THE INVENTION

The present invention relates generally to a portable target apparatus, and more particularly, relates to a portable target apparatus that rotates out of a shooter's field-of-view only when accurately struck by a predetermined number of projectiles.

BACKGROUND OF THE INVENTION

It is well known that properly training military, civilian, and law enforcement personnel in the correct use of a firearm requires special care and attention. Ideally, personnel should learn to aim the firearm at vital anatomical regions of a person when the person is posing a threat to the personnel or others. Such aim should cause the projectile to reach the vital anatomical regions in such as manner as to produce sufficient instantaneous trauma so that the person ceases to be a threat.

Known targets, e.g., solid target assemblies, are used to train personnel during accurate and prolonged engagement training drills, i.e., target practice. Engagement training drills occur at gun ranges, training camps, and the like, often utilizing a representative humanoid target. Known targets are designed to remain upright and generate an audible sound if hit by a projectile, e.g., a bullet, launched from the firearm. Other known targets generate an audible sound and drop out of the personnel's field-of-view (FOV) if hit by the projectile. A number of disadvantages are associated with these types of targets. For example, known targets that produce only an audible sound when the projectile hits the target do not provide the personnel with a visual indication of where the projectile actually hit the target. As such, the personnel is uncertain as to whether a vital anatomical region was hit by the projectile. Other known targets produce an audible sound and/or drop over out of the FOV, irrespective of where the projectile impacts the target's surface. More specifically, when a projectile hits the target surface, the target does not distinguish between non-vital anatomical regions, e.g., a region that represents a person's shoulder, and vital anatomical regions, e.g., a region that represents the person's chest. Said another way, the target produces the same audible sound and/or drops out of the personnel's FOV in exactly the same manner, irrespective of whether a vital or a non-vital anatomical region was hit by the projectile.

An additional problem presented by known targets is that the targets must be manually reset, which causes a loss in training time because a user must physically walk to the target to manually reset the target to the upright position. In addition, known targets do not provide an accurate way to predetermine the number of projectile hits that personnel must achieve within the vital anatomical region before the target drops over out of the FOV.

Therefore, a need exists to overcome the problems with the prior art as discussed above.

SUMMARY OF THE INVENTION

The invention provides a portable target apparatus that overcomes the hereinafore-mentioned disadvantages of the heretofore-known devices and methods of this general type and that rotates out of a shooter's field-of-view when at least one target plate is accurately struck by a predetermined number of projectiles.

With the foregoing and other objects in view, there is provided, in accordance with the invention a portable target apparatus including a main body and a first target plate adjacent the main body. The first target plate is operable to move independent of the main body when struck by at least one projectile. A support member is coupled to the first target plate. The support member is operable to retain the main body in an upright position when the main body is struck by at least one projectile and is operable to move the main body from the upright position to a non-upright position when the first target plate is struck by at least one projectile.

In accordance with another feature of the present invention, the main body defines at least one aperture; and the first target plate is visible through the at least one aperture.

In accordance with yet another feature of the present invention, the main body resembles a living creature and the aperture and the first target plate are in a location of at least one of a head and a chest area of the living creature.

In accordance with another feature of the present invention, the support member is operable to move the main body from the upright position to the non-upright position only when the first target plate is struck by more than one projectile.

In accordance with another feature of the present invention, the portable target apparatus includes a second target plate adjacent the main body. The second target plate is operable to move independent of the main body when struck by at least one projectile.

In accordance with an additional feature of the present invention, the main body rotates out of view of the user only when both the first target plate and the second target plate are struck by projectiles.

In accordance with another feature of the present invention, the portable target apparatus includes a second support member coupled to the second target plate. The second target plate is operable to rotate the main body from the upright position to the non-upright position when the second target plate is struck by the at least one projectile.

In accordance with an additional feature of the present invention, the portable target apparatus includes an automatic reset apparatus adjacent the main body. The automatic reset apparatus is operable to move the main body from the non-upright position to the upright position.

In accordance with another feature, one embodiment of the present invention includes a portable target apparatus having a main body; a first target plate adjacent the main body; and a support member coupled to the first target plate. The support member is operable to rotate the main body out of the view of a user when the first target plate is struck by at least one projectile.

In accordance with an additional feature of the present invention, the portable target apparatus includes a second target plate adjacent the main body and operable to rotate the main body out of the view of the user when the second target plate is struck by at least one projectile.

In accordance with an additional feature of the present invention, the main body rotates out of view of the user only when both the first target plate and the second target plate are struck by projectiles.

In accordance with a further feature of the present invention, the main body defines at least one aperture and the first target plate is visible through the at least one aperture.

In accordance with an additional feature of the present invention, the main body resembles a living creature and the aperture and the first target plate are in a location of at least one of a head and a chest area of the living creature.

In accordance with an additional feature of the present invention, at least one of the first target plate and the second target plate are operable to move the main body out of the view of the user when at least one of the first target plate and the second target plate are struck by at least one projectile.

In accordance with an additional feature of the present invention, the portable target apparatus includes an automatic reset apparatus operable to move the main body from the non-upright position to the upright position.

In accordance with yet another feature of the present invention, the automatic reset apparatus is operable to move the first target plate from a first position to a second position.

In accordance with another feature, one embodiment of the present invention includes a portable target apparatus having a main body defining at least one aperture; and a first target plate adjacent the main body that is visible through the at least one aperture. The first target plate is operable to cause the main body to remain in an upright position when the main body is struck by at least one projectile and is operable to move the main body from the upright position to a non-upright position when the first target plate is struck by at least one projectile.

In accordance with an additional feature of the present invention, the portable target apparatus includes a second target plate adjacent the main body. The second target plate is operable to cause the main body to remain in the upright position when the main body is struck by at least one projectile and is operable to move the main body to the non-upright position when the second target plate is struck by at least one projectile.

In accordance with an additional feature of the present invention, the main body is at least one of in the shape of a living creature and decorated to resemble a living creature.

In accordance with yet an additional feature of the present invention, the at least one aperture is representative of an anatomically sensitive portion of a person.

Although the invention is illustrated and described herein as embodied in a portable target apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of a main body of the portable target apparatus.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
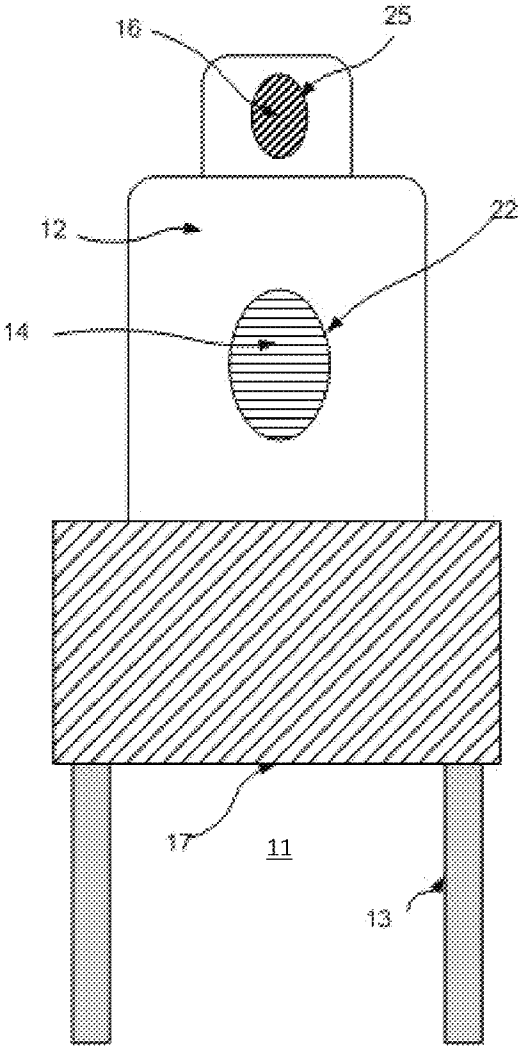
FIG. 1 is an elevational front view of a portable target apparatus showing a main body in an upright position in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient portable target apparatus that is designed mainly for use in firearms training to properly train a user to strike one or more targets, e.g., target plates, with at least one projectile or more than one predetermined projectile, e.g., bullets launched from a firearm. The portable target apparatus includes vital portions, i.e., the target plates that should be struck by the projectiles, and non-vital portions, i.e., the portions that should not be struck by the projectiles. The vital portions represent the vital portions of a person, e.g., the chest and head areas. The non-vital portions represent the non-vital portions of a person, e.g., the shoulder area. Advantageously, embodiments of the present invention provide the user with visual feedback when the target plate is accurately struck by the projectiles. More specifically, the portable target apparatus includes a main body which rotates from an upright position, i.e., within the user's field-of-view (FOV), to a non-upright position, i.e., out of the user's FOV, when at least one target plate is accurately struck by the predetermined number of projectiles.

In one embodiment, the portable target apparatus is configured such that a single projectile hit to a single target plate will cause the main body to move. In another example, a single projectile hit to one target plate and another projectile hit to a second target plate will cause the main body to move. In yet another example, two projectile hits to one target plate and a single projectile hit to the second target plate will cause the main body to move. In still yet another example, two projectile hits to a single target plate will cause the main body to move. Further combinations may be provided and are within the scope of the invention.

In addition, embodiments of the invention provide an automatic reset apparatus that moves the portable target apparatus from the non-upright position to the upright position, without user intervention. Advantageously, this provides the user with increased firearms training time as the user does not have to physically walk to the portable target apparatus to manually reset the portable target apparatus to the upright position.

Referring now to FIG. 1, one embodiment of the present invention is shown in an elevational front view. FIG. 1 shows several advantageous features of the present invention, but, as will be described below, the invention can be provided in several shapes, sizes, combinations of features and components, and varying numbers and functions of the components. The first example of a portable target apparatus 11, as shown in FIG. 1, includes a main body 12 attached to a base frame 13. In a preferred embodiment, the main body 12 is sized and shaped to resemble a living creature. The term "living creature" is defined herein as a person, an animal, or a fictitious monster portrayed as living. Said another way, the fictitious monster may be a person decorated to resemble a fictitious monster, e.g., a person wearing an animal costume. In another embodiment, the main body 12 is of a rectangular shape. In other embodiments, the main body 12 is of a square or other similar shape. In a preferred embodiment, the main body 12 is made of a steel material, capable of withstanding the force of a projectile 15 (FIG. 3) striking the main body 12. In one embodiment, the main body 12 is an AR500 abrasion steel plate. In other embodiments, the main body 12 may be made of a metal or other material capable of withstanding the force of the projectile 15. In a preferred embodiment, the projectile 15 is a bullet launched from a firearm. In one example, a .308 Winchester may be used. In another embodiment, the projectile 15 may be an arrow, such as an arrow launched from a bow. In one embodiment, the portable target apparatus 11 may be used at extended ranges for long range sniper training. In another embodiment, the portable target apparatus 11 may be used at a short distance range for short distance range training.

Figure 3:
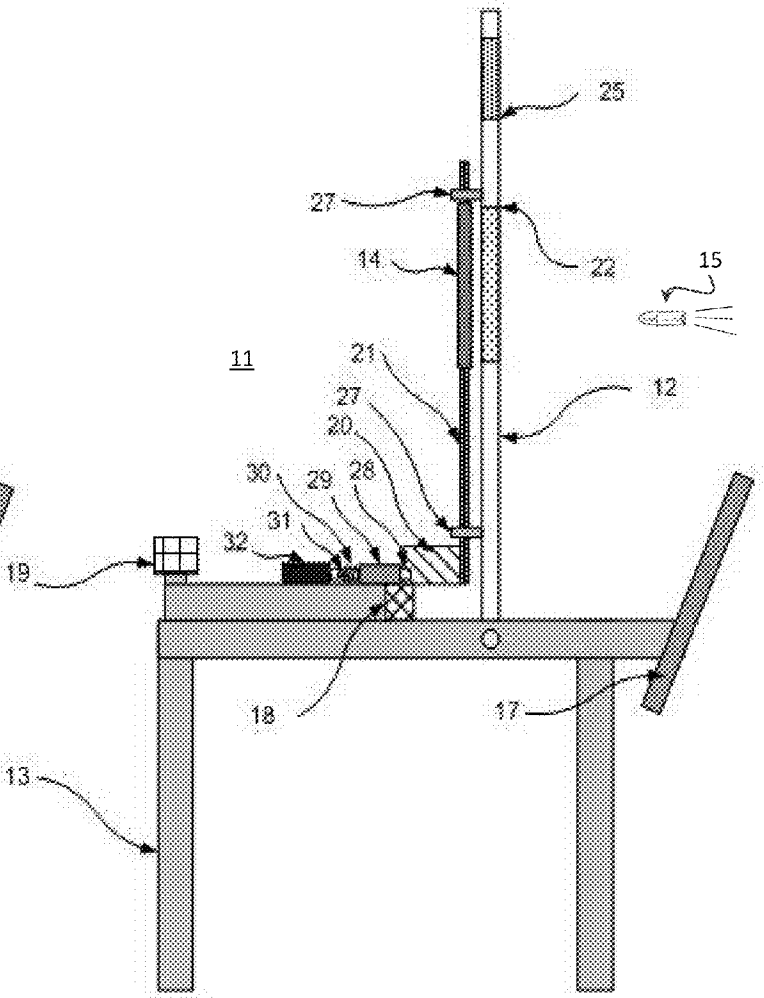
FIG. 3 is an elevational side view of the portable target apparatus of FIG. 1 showing the main body in the upright position and a first target plate adjacent the main body.

In one embodiment, the main body 12 includes a non-vital portion which represents the portion of the main body 12 that the user should aim to avoid during the firearms training. In one embodiment, the entire main body 12 represents the non-vital portion. In this embodiment, at least one target plate, i.e., a first target plate 14, represents the vital portion that the user should aim to strike with the projectile 15 (FIG. 3). In other embodiments, a select portion of the main body 12 may represent the non-vital portion. Advantageously, the main body 12 will remain in the upright position if the user strikes only the non-vital portion of the main body 12, providing the user with a visual indication that the main body 12, and not the target plate, i.e., the first target plate 14, was hit by the projectile 15.

The main body 12 may be secured to the base frame 13 such that the main body 12 remains in the upright position when the projectile 15 (FIG. 3) strikes the main body 12. The main body is operable to move from the upright position (FIG. 1) to a non-upright position (FIG. 2) when at least one target plate, i.e., the first target plate 14, adjacent the main body 12 is struck by the predetermined number of projectiles, as will be explain further herein. In a preferred embodiment, the upright position is a vertical position. The non-upright position is a position that is visually distinct from the upright position, such as a horizontal position, an upside down position, or the like. In another embodiment, the main body 12 is operable to move from the upright position to the non-upright position when a second target plate 16 adjacent the main body 12 is struck by the predetermined number of projectiles. In yet another embodiment, the main body 12 is operable to move from the upright position to the non-upright position when both the first target plate 14 and the second target plate 16 are struck by the predetermined number of projectiles. In other embodiments, the main body 12 is operable to move when more than two target plates are struck by the predetermined number of projectiles. The additional target plates may be positioned above, beside, or below the main body 12.

In one embodiment, the first target plate 14 and the second target plate 16 are representative of anatomically sensitive, i.e., vital portions, of a living creature, e.g., the torso or center mass of a human body, and the head of the human body, respectively. The term "anatomically sensitive" is defined herein as susceptible to undergoing instantaneous trauma when struck by the projectile 15 (FIG. 3). FIG. 1 depicts the first target plate 14 visible through at least one aperture 22 defined by the main body 12. The second target plate 16 is visible through a second aperture 25 defined by the main body 12. In one embodiment, the aperture 22 may be approximately 6.0 to 8.0 inches in length. In one embodiment, the second aperture 25 may each be approximately 4.0 inches to 5.0 inches in length. In other embodiments, the length of the apertures 22, 25 may vary outside of this range. In other embodiments, the main body 12 may be a solid structure that is free of apertures. In another embodiment, the first target plate 14 and the second target plate 16 may be positioned next to the main body 12. In other embodiments, the first target plate 14 and the second target plate 16 may be positioned above, beside, or below the main body, though the embodiment of FIG. 1 is a preferred embodiment as it achieves a main goal of the present invention, e.g., to train the user to strike the vital anatomical portions with the projectile 15 (FIG. 3).

In one embodiment, at least one of the first target plate 14 and the second target plate 16 may be located outside of the main body 12, e.g., adjacent a shoulder portion of the main body 12. In this embodiment, the main body 12 is configured to be the solid structure free of apertures. The main body 12 may represent an innocent bystander that the user should aim to avoid striking with the projectile 15 (FIG. 3). The at least one of the first target plate 14 and the second target plate 16 represent the vital portion that the user should aim to strike with the projectile 15 (FIG. 3) to cause the main body 12 to move from the upright to the non-upright position. More specifically, the user should aim to launch the projectile 15 (FIG. 3) over the shoulder portion of the main body 12 to strike at least one of the first target plate 14 and the second target plate 16 that is positioned outside of the main body 12.

In one embodiment, the first target plate 14 and the second target plate 16 are operable to move from a first position to a second position when struck by at least one projectile 15. The movement may be from right to left, left to right, upward and downward, or any other similar combination of movement. In one embodiment, the first target plate 14 and the second target plate 16 may move in the same direction. In other embodiments, the first target plate 14 and the second target plate 16 may move in different directions.

In one embodiment, the portable target apparatus 11 includes a front wall 17 positioned on the base frame 13 which acts a shield to prevent the projectile 15 from striking any portion of the portable target apparatus 11 that is not designed to sustain the impact, i.e., force, from the projectile. In other embodiments, the portable target apparatus 11 may be utilized without the front wall 17. The front wall 17 may be a steel plate or another similar durable structure capable of deflecting the projectile 15 when contacting the front wall 17.

Figure 2:
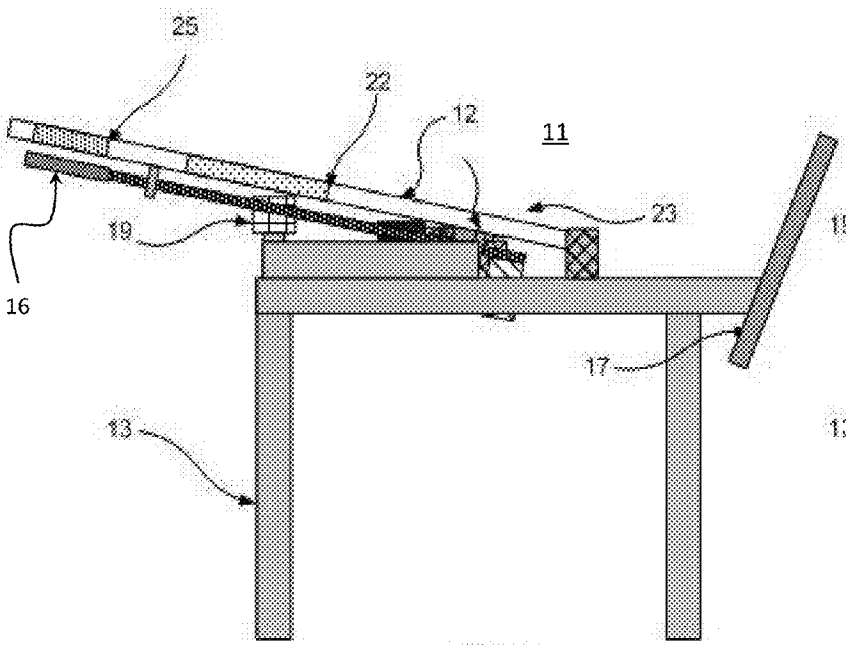
FIG. 2 is an elevational side view of the portable target apparatus of FIG. 1 showing the main body in a non-upright position.

FIG. 2 depicts an elevational side view of the main body 12 in the non-upright position, such as when the user has accurately struck the second target plate 16 with the predetermined number of projectiles. The main body 12 can be seen defining the aperture 22 and the second aperture 25. FIG. 2 depicts the portable target apparatus 11 having a vibration isolator 19 located behind the main body 12. In another embodiment, the vibration isolator 19 may be located along the base frame 13. Generally speaking, the vibration isolator 19 is configured to reduce the impact of the main body 12 striking the base frame 13, e.g., the steel to steel impact produced when the main body 12 moves from the upright to the non-upright position and comes into contact with the base frame 13. In one embodiment, the vibration isolator 19 is a spring positioned between a pair of top and bottom plate assemblies having noise isolation pads. In another embodiment, the vibration isolator 19 is a spring assembly housed by at least one of an iron, steel, and aluminum housing that includes noise isolation pads. The vibration isolator 19 may be coupled to the portable target apparatus 11 by a plurality of fasteners, e.g., bolts, screws, or another type of fastener. In other embodiments, the vibration isolator 19 may be another type of vibration isolator.

Referring now to FIG. 3, in one embodiment, the aperture 22 and the second aperture 25 may correspond to the vital portions, rather than the first target plate 14 and the second target plate 16 corresponding to the vital portions, as depicted in FIG. 1. In this embodiment, the aperture 22 corresponds to the center mass of the human body and the second aperture 25 corresponds to the head of the human body.

Referring still to FIG. 3, in this exemplary embodiment, the portable target apparatus 11 is configured such that at least one accurate projectile hit to the first target plate 14 will move the main body 12 from the upright position to the non-upright position. In one embodiment, the main body 12 is maintained in the upright position by way of the first target plate 14 coupled to a support column 21 and a support member 20. Said another way, the support member 20 and the support column 21 secure the main body 12 in the upright position. In one embodiment, the support column 21 is a steel bar. In another embodiment, the support column 21 may be a steel rod, a metal pole, or another similar structure. In one embodiment, the support member 20 is an L-shaped bracket. In another embodiment, the support member 20 is a steel bracket forming a 90 degree angle. In other embodiments, the support member 20 is another similar device. The support column 21 is affixed to the main body 12 by a pair of support column mounts 27. In one embodiment, the support column mounts 27 are steel brackets. In another embodiment, the support column mounts 27 are metal fasteners. In another embodiment, the support column 21 may be affixed to the main body 12 by a single support column mount. In other embodiments, the support column 21 may be affixed to the main body by a plurality of support column mounts.

The support member 20 is positioned over and engages a support platform 18. More specifically, at least a portion of the support member 20 is positioned over the support platform 18. The support member 20 is designed such that the support member can rotate from a position on the support platform 18 to a position off of the support platform 18. In use, as the projectile 15 passes thru the aperture 22 and strikes the first target plate 14, the energy produced from the impact causes the first target plate 14 to move away from the main body 12. Resultantly, the energy is transferred down the support column 21, causing the support member 20 to rotate from a position on the support platform 18 to a position off the support platform 18. As a result, the main body 12 drops from the upright position to the non-upright position (FIG. 2), i.e., out of the view of the user. Advantageously, the user is provided with visual feedback when accurately striking the first target plate 14, rather than audible feedback only, as is the case with other known target apparatuses. As a further advantage, the portable target apparatus 11 distinguishes between non-vital and vital anatomical portions. FIG. 3 depicts the vibration isolator 19 present to stabilize the impact of the main body 12 after the main body 12 has been struck by the predetermined number of projectiles 15.

Figure 11:
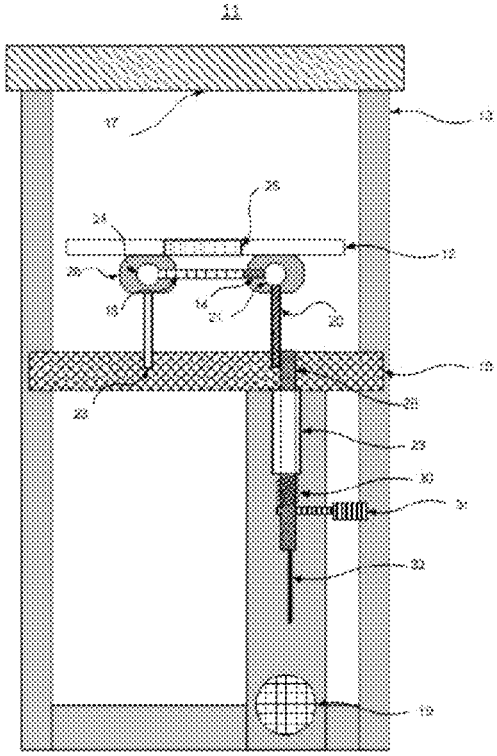
FIG. 11 is an elevational downward-looking view of the portable target apparatus of FIG. 7 showing the latch adjacent the support member and the support member and the second support member positioned off on the support platform.

FIG. 3 in conjunction with FIGS. 7 and 11-14, the latter of which, each show an elevational downward-looking view of the portable target apparatus 11 in various configurations, as will be explained further herein. Generally speaking, FIGS. 3, 7, and 11-14 each depict a latch 28, i.e., a pin, adjacent the support member 20. The latch 28 is configured to both secure the main body 12 in the upright position and allow the main body 12 to move when the first target plate 14 is struck by the projectile 15. More specifically, FIGS. 3 and 11 depict the latch 28 held in a forward position adjacent the support member 20, thereby preventing the support member 20 from rotating off the support platform 18. The latch 28 is held in the forward position by means of a latch spring 30, a latch set plate 32, and a hit selection arm 31. The hit selection arm 31 is the component that may be moved, for example, by the firearm's training instructor, to select the number of times the first target plate 14 must be struck by the projectiles 15, before the main body 12 will move.

With reference mainly to FIG. 3, in conjunction with FIGS. 7 and 12-14, in use, when the first target plate 14 is struck by at least one projectile 15, the latch 28 is propelled into a latch housing 29. The latch housing 29 is shown having an inner diameter larger than the outer diameter of the latch 28. The energy generated by the projectile 15 striking the first target plate 14 causes the latch 28 to rotate off of the latch set plate 32. The support member 20 then rotates against the latch 28 and the latch spring 30 forces the latch 28 into the latch housing 29. As a result, the latch 28 no longer impedes the rotation of the support member 20 and the support member 20 is able to rotate off of the support platform 18 when the first target plate 14 is struck an additional time with the projectile 15, causing the main body 12 to move from the upright position to the non-upright position.

Figure 5:
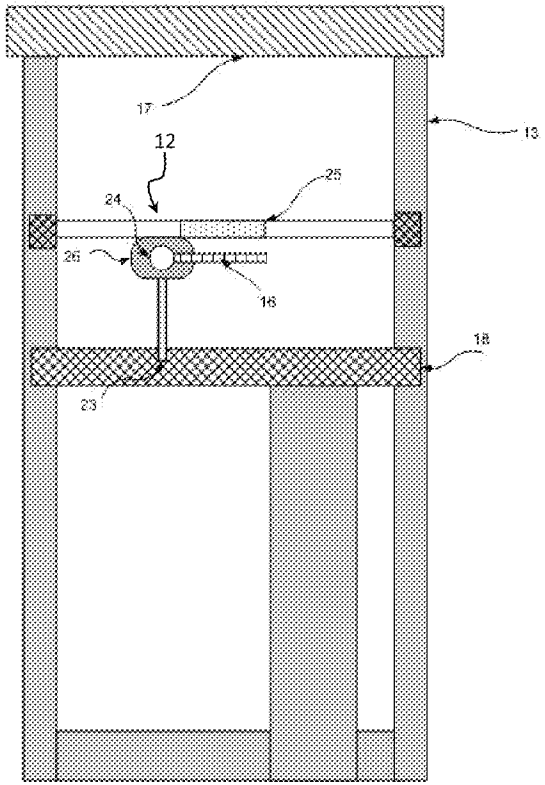
FIG. 5 is an elevational downward-looking view of the portable target apparatus of FIG. 1.
Figure 4:
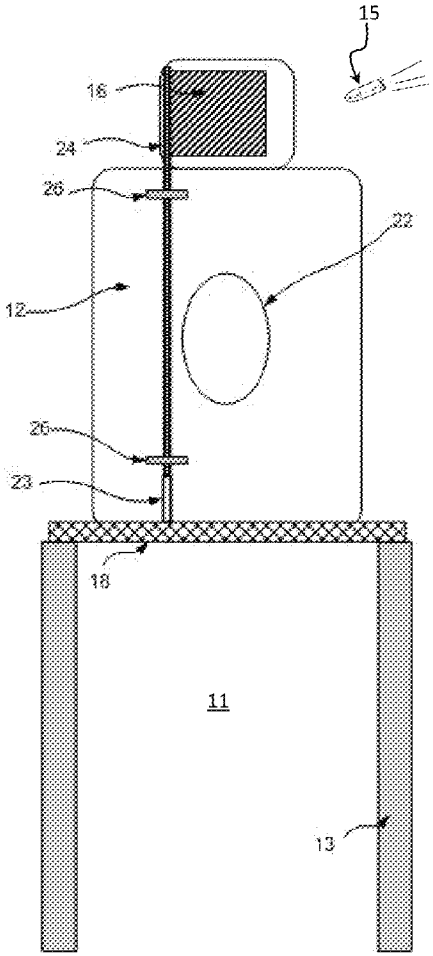
FIG. 4 is an elevational rear view of the portable target apparatus of FIG. 1 showing a second target plate adjacent the main body in accordance with the present invention.

Referring now to FIGS. 4 and 5, an elevational rear view of the portable target apparatus 11 and an elevational downward-looking view of the portable target apparatus 11 are shown. In this exemplary embodiment, the portable target apparatus 11 is configured such that one accurate projectile hit to the second target plate 16 will move the main body 12 from the upright position to the non-upright position. In one embodiment, the main body 12 is maintained in the upright position by way of the second target plate 16 attached to a second support column 24 and a second support member 23. Said another way, the second support member 23 and the second support column 24 secure the main body 12 in the upright position. The second support column 24 is affixed to the main body 12 by a pair of second support column mounts 26. In another embodiment, the second support column 24 may be affixed to the main body 12 by a single second support column mount. In other embodiments, the second support column 24 may be affixed to the main body by a plurality of second support column mounts. The second support member 23 is positioned over and engages the support platform 18.

With reference to FIG. 4 in conjunction with FIG. 5, in use, as the projectile 15 travels through the second aperture 25 to strike the second target plate 16 from the front, the energy produced from the impact causes the second target plate 16 to move away from the main body 12. Resultantly, the energy is transferred down the second support column 24, causing the second support member 23 to rotate from a position on the support platform 18 to a position off of the support platform 18. As a result, the main body 12 drops from the upright position (FIG. 4) to the non-upright position (FIG. 5). In another embodiment, the user may select a predetermined number of projectiles necessary to rotate the second support member 23 off of the support platform 18. FIG. 5 depicts the front wall 17 positioned on the base frame 13 which acts as the shield to prevent the projectile 15 from striking any portion of the portable target apparatus 11 that is not intended to be struck by the projectile 15.

Figure 6:
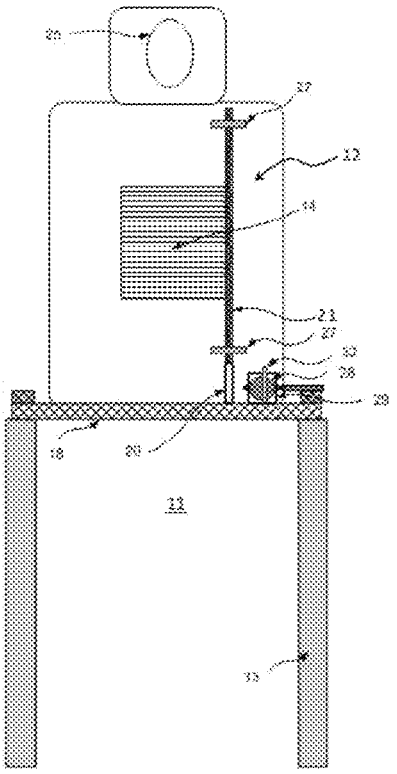
FIG. 6 is an elevational rear view of the portable target apparatus of FIG. 1 showing a support column and a support member coupled to the first target plate.
Figure 7:
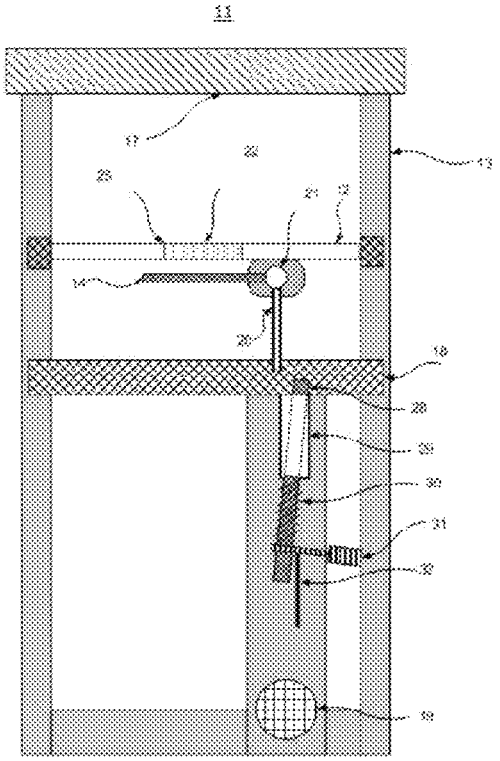
FIG. 7 is an elevational downward-looking view of a portable target apparatus having a latch adjacent the support member in accordance with an exemplary embodiment of the present invention.

FIGS. 6 and 7 depict an elevational rear view and an elevational downward-looking view of the portable target apparatus 11, respectively. In this embodiment, the portable target apparatus 11 is configured such that one accurate projectile hit to the first target plate 14 will move the main body 12 from the upright position to the non-upright position. More specifically, when the projectile 15 (as shown in FIG. 3) strikes the first target plate 14, the energy in the projectile 15 transfers to the first target plate 14 and causes the first target plate 14 to rotate away from the main body 12. The action of the first target plate 14 being attached to the support column 21 and the support member 20, causes the support member 20 to rotate to a position off the support platform 18. FIG. 7 shows the vibration isolator 19 present to lessen the mechanical impact of the main body 12 striking the base frame 13.

Figure 9:
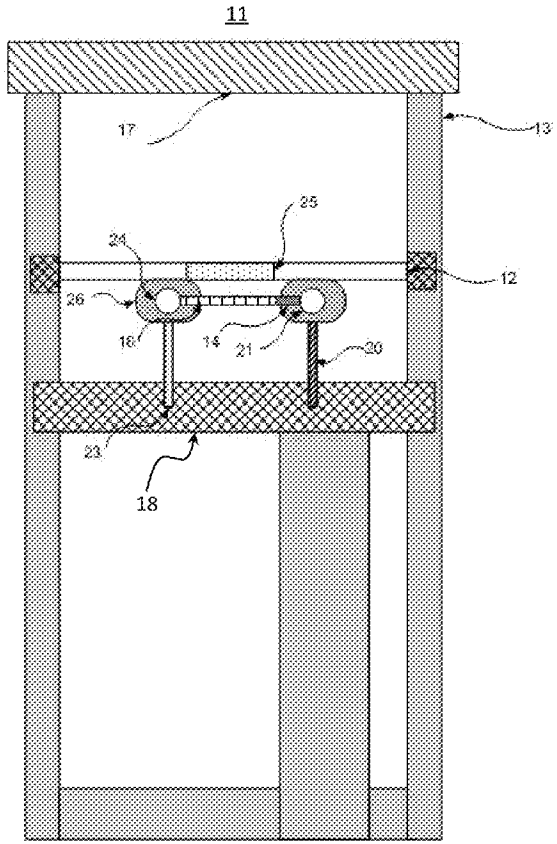
FIG. 9 is an elevational downward-looking view of the portable target apparatus of FIG. 1 showing the support member and the second support member positioned on the support platform.
Figure 8:
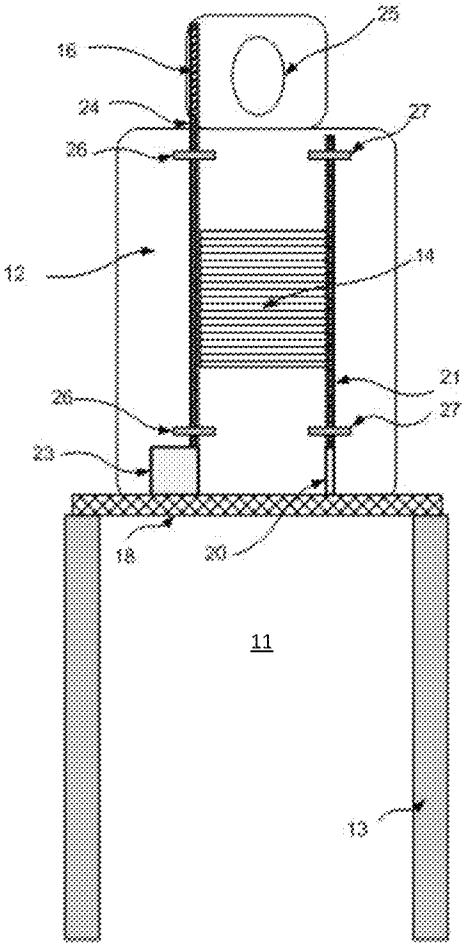
FIG. 8 is an elevational rear view of the portable target apparatus of FIG. 1 showing the support column and the support member coupled to the first target plate and a second support column and a second support member coupled to the second target plate and positioned on the support platform.

FIGS. 8 and 9 depict the portable target apparatus 11 in a configuration such that the user may be required to strike the first target plate 14 and the second target plate 16 in order to move the main body 12 from the upright position to the non-upright position. Advantageously, the user, the firearms instructor, or the like, can predetermine the number of target plates the user must strike to cause the main body 12 to move by placing at least one of the support member 20 and the second support member 23 on or off the support platform 18. FIG. 8 in conjunction with FIG. 9 depict the support column 21, the support column mounts 27, the second support column 24, and the second support column mounts 26 are as previously described herein. FIG. 8 depicts the portable target apparatus in a configuration such that the projectile 15 traveled through the second aperture 25 to strike the second target plate 16 and the first target plate 14 must be hit by an additional projectile 15 in order for the main body 12 to move from the upright position to the non-upright position. FIG. 9 depicts the portable target apparatus 11 in a configuration such that the support member 20 and the second support member 23 are on the support platform 18.

Figure 10:
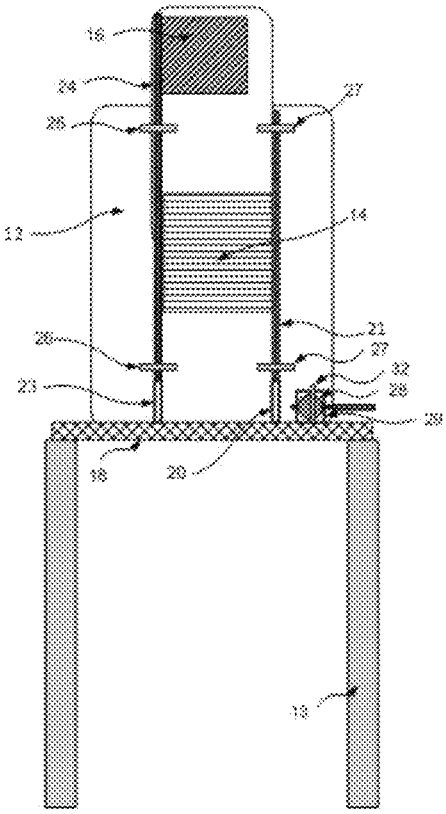
FIG. 10 is an elevational rear view of the portable target apparatus of FIG. 1 showing the first target plate and the second target plate in a first position and the support member and the second support member positioned on the support platform.

FIG. 10 depicts the support member 20 and the second support member 23 positioned on the support platform 18. In this configuration, the user may be required to strike the first target plate 14 in order to move the support member 20 from the support platform and may be required to strike the second target plate 16 in order to move the second support member 23 from the support platform 18. Resultantly, in use, once the support member 20 and the second support member 23 move from the support platform, the main body 12 moves from the upright to the non-upright position. Advantageously, the user is provided with a visual indication that the vital anatomical portions, i.e., the first target plate 14 and the second target plate 16, were accurately struck by the user. As an added advantage, the user does not have to strike either target in any particular order; rather, the main body 12 moves independent of the order in which the user strikes the first target plate 14 and the second target plate 16. In other embodiments, the support member 20 and the second support member 23 may be placed in alternate configurations with respect to the support platform 18. FIG. 10 in conjunction with FIG. 11, depict the support column 21, the support column mounts 27, the second support column 24, and the second support column mounts 26 as previously described herein.

Figure 12:
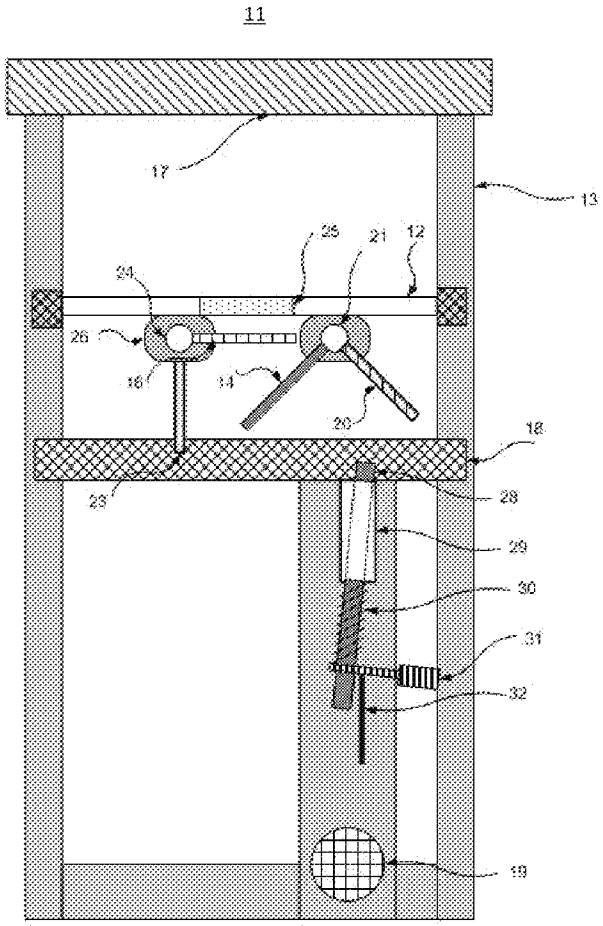
FIG. 12 is an elevational downward-looking view of the portable target apparatus of FIG. 7 showing the latch retained with a latch housing and the support member positioned off of the support platform and the second support member positioned on the support platform.

FIG. 12 depicts the second support member 23 positioned on the support platform 18 and the support member 20 positioned off of the support platform 18. The second target plate 16 is depicted behind the second aperture 25 defined by the main body 12. In this embodiment, the portable target apparatus 11 is configured such that one projectile hit to the target plate 16 will cause the second support member 23 to move off of the support platform 18. Resultantly, the second target plate 16 will move from the first position to the second position allowing the main body 12 to move from the upright position to the non-upright position. The vibration isolator 19 can be seen attached to the base frame 13.

Figure 14:
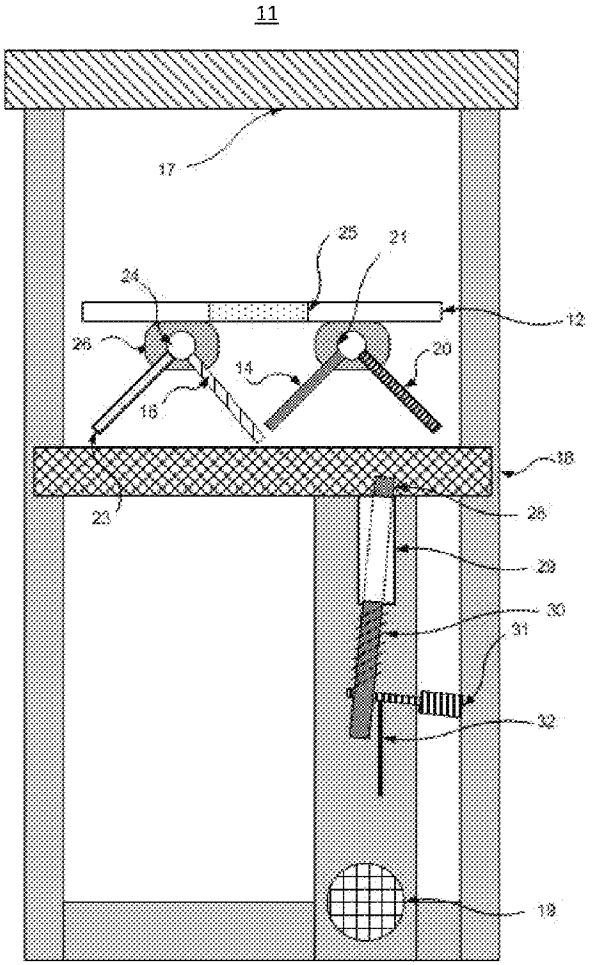
FIG. 14 is an elevational downward-looking view of the portable target apparatus of FIG. 7 showing the latch retained within the latch housing and the support member and the second support member position off of the support platform.
Figure 13:
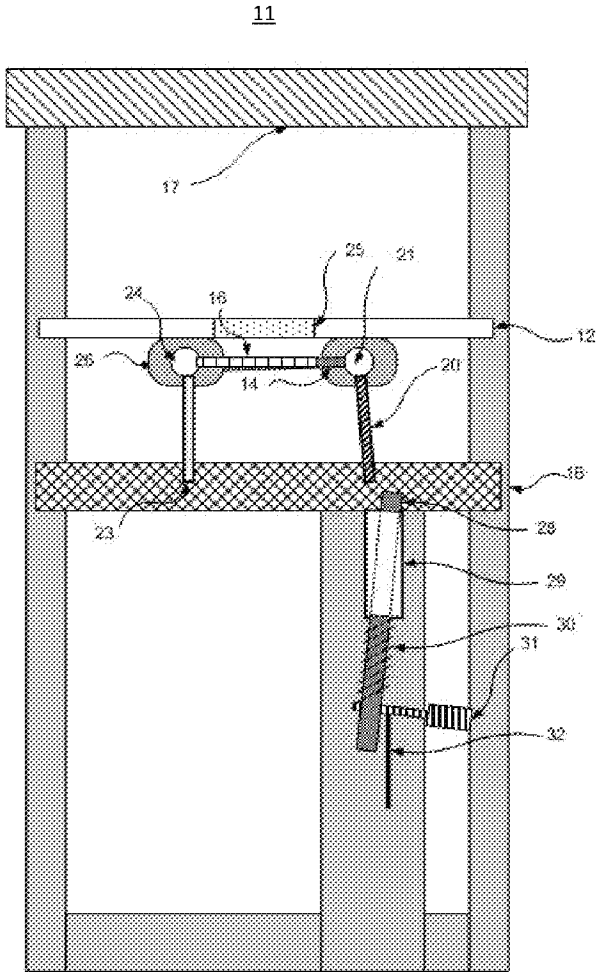
FIG. 13 is an elevational downward-looking view of the portable target apparatus of FIG. 7 showing the latch retained within the latch housing and the support member and the second support member positioned on the support platform.

FIG. 13 depicts the first target plate 14 and the second target plate 16 in the first position, i.e., prior to the projectile hits. FIG. 14 depicts the first target plate 14 and the second target plate 16 in the second position, i.e., following the projectile hits. More specifically, FIG. 13 depicts the support member 20 and the second support member 23 on the support platform 18. The first target plate 14 and the second target plate 16 are in the first position, i.e., adjacent the main body 12 in preparation for the projectile hits. FIG. 14 depicts the support member 20 and the second support member 23 off of the support platform. The first target plate 14 and the second target plate 16 are in the second position, i.e., following the projectile hits. The latch 28 is depicted within the latch housing 29 such that the latch 28 no longer obstructs the support member 20. The latch spring 30 is depicted adjacent the latch housing 29. As previously mentioned above, the latch set plate 32 and the hit selection arm 31 allow the user to configure the portable target apparatus 11 to predetermine the number of projectile hits that must strike the first target plate 14 in order for the main body 12 to move.

Figure 15:
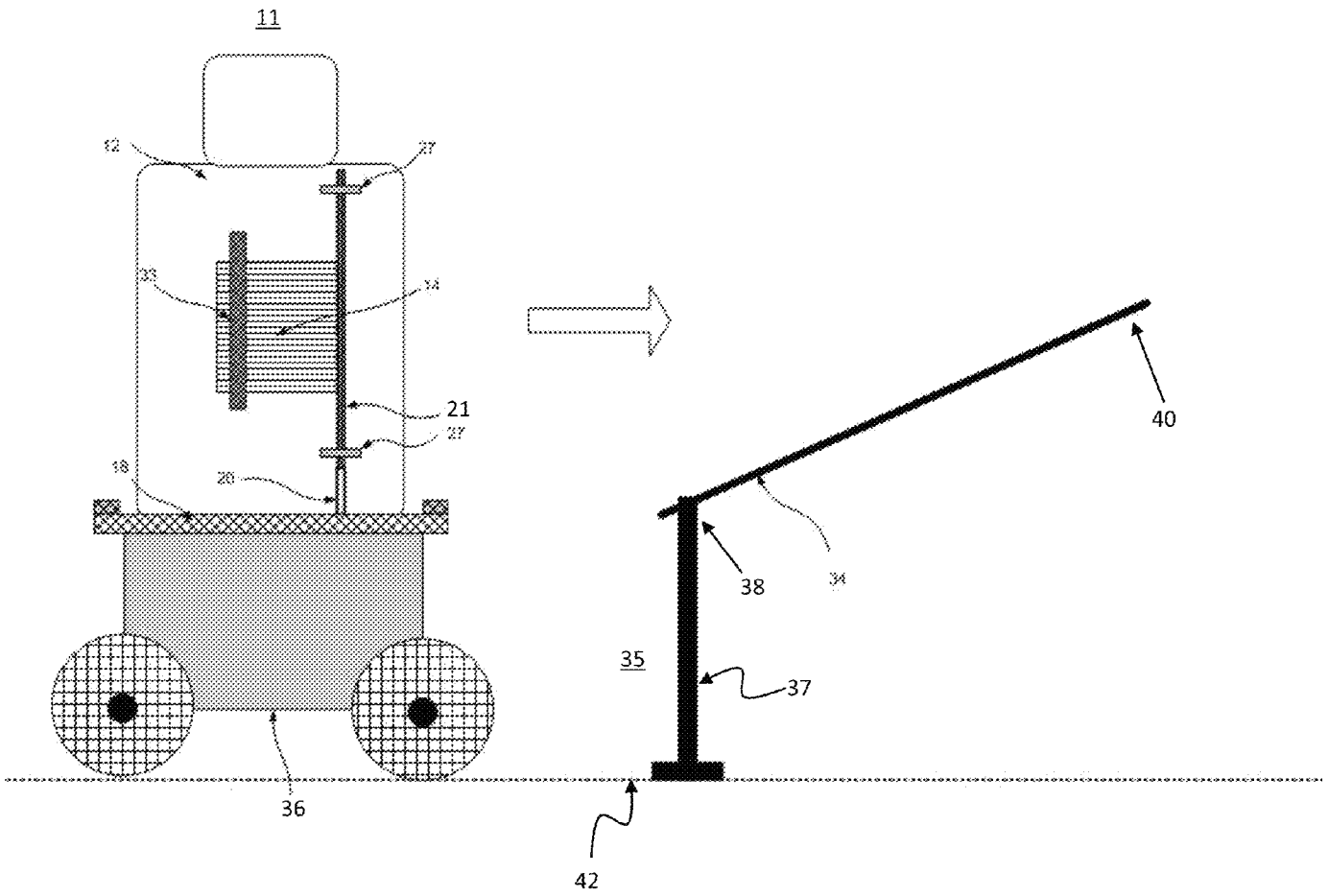
FIG. 15 is an elevational rear view of the portable target apparatus of FIG. 1 showing the portable target apparatus in the upright position and an automatic reset apparatus operable to reset the main body from the non-upright position to the upright position.
Figure 16:
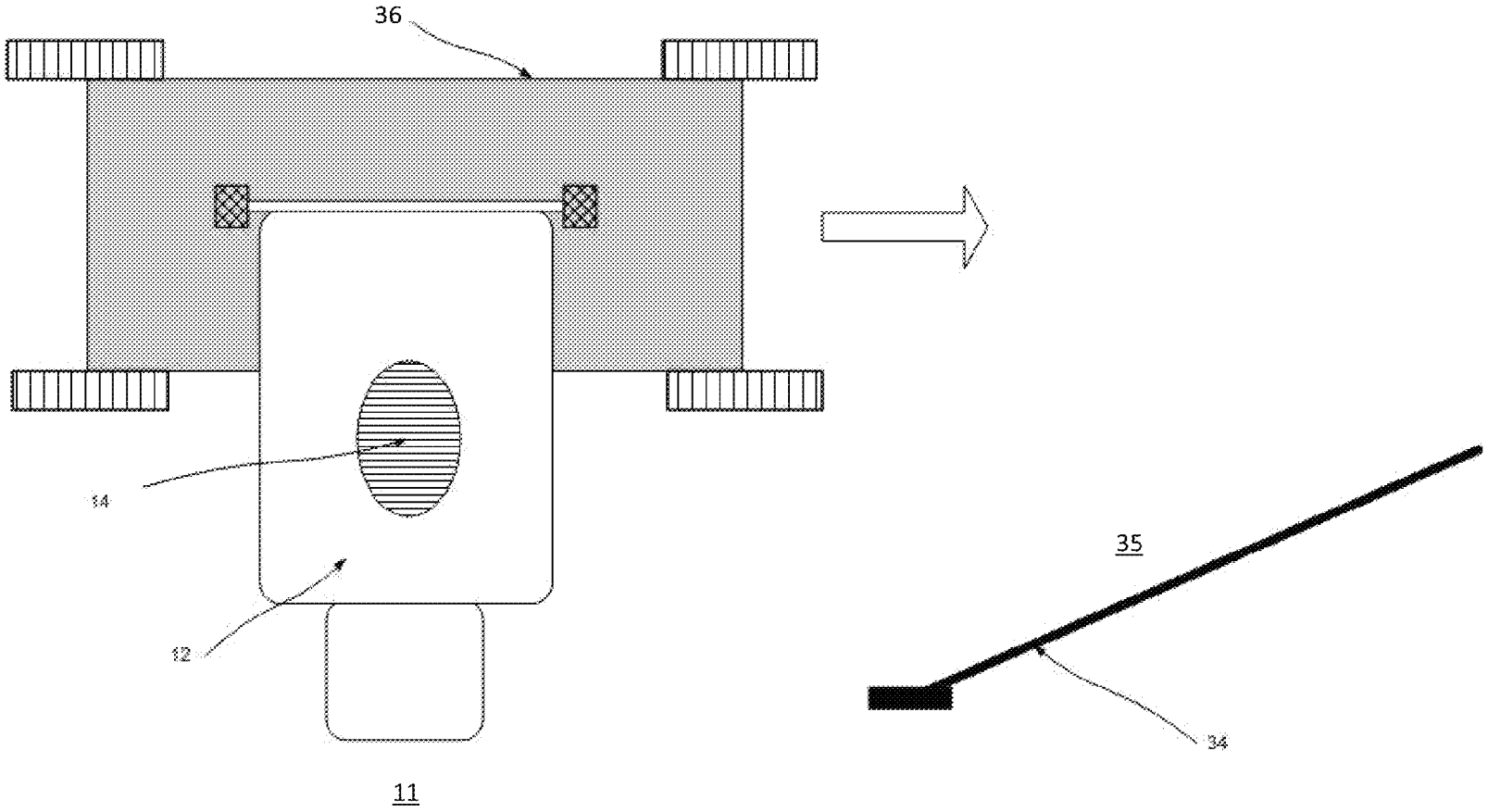
FIG. 16 is an elevational downward-looking view of the portable target apparatus of FIG. 1 in the non-upright position adjacent the automatic reset apparatus.

With reference to FIGS. 15 and 16, in one embodiment, the portable target apparatus 11 includes an automatic reset apparatus 35. The automatic reset apparatus 35 is operable to move the main body 12 from the non-upright position depicted in FIG. 16 to the upright position depicted in FIG. 15, i.e., from out of the view of the user into the view of the user. FIG. 15 depicts a rear view of the portable target apparatus 11 and the automatic reset apparatus 35. FIG. 16 depicts an elevational downward looking view of the portable target apparatus 11 and the automatic reset apparatus 35. The automatic reset apparatus 35 may also be operable to move at least one of the first target plate 14 (FIG. 10) and the second target plate 16 from the first position to the second position, without user intervention. Advantageously, the user, firearms instructor, or the like does not have to lose valuable training time by manually resetting the main body 12, the first target plate 14, and the second target plate 16 to the upright or first position.

In one embodiment, the automatic reset apparatus 35 may operate in conjunction with the main body 12 and the support platform 18 mounted on a target moving apparatus 36. The target moving apparatus 36 is operable to move the portable target apparatus 11 from a first location to a second location, which may be representative of a moving target during firearms training. In one embodiment, the target moving apparatus 36 may move along a conveyor to propel the portable target apparatus 11 from the first location to the second location. In another embodiment, the target moving apparatus 36 may move along a ground surface 42 using a plurality of wheels.

FIG. 15 depicts an elevational rear view of the portable target apparatus 11 showing the support column 21 and the support column mounts 27 coupling the first target plate 14 to the rear of the main body 12. The support member 20 can be seen positioned on the support platform 18. In one embodiment, the automatic reset apparatus 35 includes a lift member 33 coupled the rear of the main body 12. In another embodiment, the automatic reset apparatus 35 includes the lift member 33 coupled to a railing 34. In one embodiment, the lift member 33 is a steel bar. In other embodiments, the lift member 33 is a metal bar, or other similar durable lift member.

In order to reset the main body 12 from the non-upright position to the upright position, the target moving apparatus 36 may move along a path of the railing 34 from a first end 38 to a second end 40. The railing 34 may be secured to a vertical member 37 at the first end 38 to elevate the railing 34 from the ground surface 42. In one embodiment, the vertical member 37 may be a steel pole. In another embodiment, the vertical member may be metal pole or another similar durable structure. FIG. 15 depicts the railing 34 at an angle that is higher at the second end 40 than at the first end 38. In one embodiment, in use, as the portable target apparatus 11 moves from the first location to the second location, the lift member 33 attached to the main body 12 engages, i.e., passes over, the railing 34 and the angle of the railing 34 causes the main body 12 to move in a forward and upright motion to reset the main body 12 into the upright position. In another embodiment, in use, as the portable target apparatus 11 moves from the first location to the second location, the rear of the main body 12 engages the lift member 33 attached to the railing 34 and the angle of the railing 34 causes the main body 12 to reset into the upright position.

Advantageously, the addition of the lift member 33 prevents the edge of the main body 12 from contacting the railing 34. Said another way, without the lift member 33, the edge of the main body 12 would contact the edge of the railing 34 and the coefficient of friction between the edge of the railing 34 and the edge of the main body 12 would be excessive, preventing the main body 12 from returning to the upright position.

In one embodiment, the automatic reset apparatus 35 may include a battery and a motor operable to reset the main body 12 from the non-upright position to the upright position. In another embodiment, the automatic reset apparatus 35 may be powered by electricity. The source of the electricity may be a solar panel, an electric power grid, etc. In one embodiment, the automatic reset apparatus 35 may include a sensor for signaling when the main body 12 is dropped to the non-upright position, i.e., out of the shooter's field of view. In this embodiment, the automatic reset apparatus 35 may include an arm coupled to the main body 12 that contacts the automatic reset apparatus 35 to reset the main body 12 to the upright position.

A portable target apparatus has been disclosed that features a target plate that must be accurately struck by a predetermined number of projectiles in order to move a main body from an upright position to a non-upright position, providing a user with a visual indication that the target plate was accurately struck. It is envisioned that the portable target apparatus will be used mainly in firearms training. In addition, embodiments of the invention provide the user with the ability to tailor the number of projectile hits that must strike one or more target plates, before the main body moves. Other features of the invention have been disclosed that include an automatic reset apparatus for moving the portable target apparatus from a non-upright to an upright position, without user intervention, but are not intended to be limited to the particular details disclosed herein.

What is claimed is:

1. A portable target apparatus, comprising:

a main body of a material impenetrable to a bullet and defining at least one aperture;

a first target plate adjacent the main body, visible through the at least one aperture, and operable to move independent of the main body when struck by at least one projectile;

and a support member coupled to the first target plate, the support member operable to:

retain the main body in an upright position when the main body is struck by at least one projectile; and move the main body from the upright position to a non-upright position when the first target plate is struck by at least one projectile; and a second support member coupled to the second target plate, the second support member operable to:

retain the main body in an upright position when the main body is struck by at least one projectile; and move the main body from the upright position to a non-upright position when the second target plate is struck by at least one projectile.

2. The portable target apparatus of claim 1, wherein:

the main body resembles a living creature and the aperture and the first target plate are in a location of at least one of a head and a chest area of the living creature.

3. The portable target apparatus of claim 1, wherein:

the support member is operable to move the main body from the upright position to the non-upright position only when the first target plate is struck by more than one projectile.

4. The portable target apparatus of claim 1, wherein:

the main body rotates out of view of the user only when both the first target plate and the second target plate are struck by projectiles.

5. The portable target apparatus of claim 1, further comprising:

an automatic reset apparatus adjacent the main body, the automatic reset apparatus operable to move the main body from the non-upright position to the upright position.

6. A portable target apparatus, comprising:

a main body of a material impenetrable by a bullet and defining at least one aperture;

a first target plate adjacent the main body and visible through the at least one aperture;

a second target plate adjacent the main body; and a support member coupled to the first target plate, the support member operable to rotate the main body out of view of a user when the first target plate is struck by at least one projectile; and a second support member coupled to the second target plate, the second support member operable to:

retain the main body in an upright position when the main body is struck by at least one projectile; and move the main body from the upright position to a non-upright position when the second target plate is struck by at least one projectile.

7. The portable target apparatus of claim 6, wherein:

the main body rotates out of view of the user only when both the first target plate and the second target plate are struck by projectiles.

8. The portable target apparatus of claim 6, wherein:

the main body resembles a living creature and the aperture and the first target plate are in a location of at least one of a head and a chest area of the living creature.

9. The portable target apparatus of claim 6, further comprising:

an automatic reset apparatus operable to move the main body from the non-upright position to the upright position.

10. The portable target apparatus of claim 9, wherein:

the automatic reset apparatus is operable to move the first target plate from a first position to a second position.

11. A portable target apparatus comprising:

a main body of a material impenetrable to a bullet and defining at least one aperture;

a first target plate adjacent the main body, visible through the at least one aperture, and operable to cause the main body to:

remain in an upright position when the main body is struck by at least one projectile; and move from the upright position to a non-upright position when the first target plate is struck by at least one projectile; and a second target plate adjacent the main body, the second target plate operable to cause the main body to:

remain in the upright position when the main body is struck by at least one projectile; and move from the upright position to the non-upright position when the second target plate is struck by at least one projectile.

12. The portable target apparatus of claim 11, wherein:

the main body is at least one of in the shape of a living creature and decorated to resemble a living creature.

13. The portable target apparatus of claim 11, wherein:

the at least one aperture is representative of an anatomically sensitive portion of a person.

* * * * *